US006720880B2

(12) United States Patent
Gutta et al.

(10) Patent No.: US 6,720,880 B2
(45) Date of Patent: Apr. 13, 2004

(54) VISION-BASED METHOD AND APPARATUS FOR AUTOMATICALLY ACTIVATING A CHILD SAFETY FEATURE

(75) Inventors: Srinivas Gutta, Yorktown Heights, NY (US); Vasanth Philomin, Hopewell Junction, NY (US); Miroslav Trajkovic, Ossining, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 194 days.

(21) Appl. No.: 10/014,198

(22) Filed: Nov. 13, 2001

(65) Prior Publication Data

US 2003/0093200 A1 May 15, 2003

(51) Int. Cl.[7] ..... G08B 23/00
(52) U.S. Cl. ..... 340/573.4; 348/156
(58) Field of Search ..... 340/573.4, 573.1, 340/539.15; 348/156, 152, 143

(56) References Cited

U.S. PATENT DOCUMENTS 4,779,095 A * 10/1988 Guerreri ..... 340/904
4,951,786 A * 8/1990 Haraguchi ..... 348/143
5,436,613 A * 7/1995 Ghosh et al. ..... 340/573.1
5,497,149 A * 3/1996 Fast ..... 340/988
5,793,290 A * 8/1998 Eagleson et al. ..... 340/573.1
5,844,487 A * 12/1998 Britt ..... 340/573.1
6,005,958 A 12/1999 Farmer et al. ..... 382/103

FOREIGN PATENT DOCUMENTS

DE 19947062 A 4/2000 ..... H04N/5/14
EP 0356734 A2 7/1990 ..... G08B/13/18
EP 1061487 A1 12/2000 ..... G08B/13/194

OTHER PUBLICATIONS

Colmenarez et al., "Maximum Likelihood Face Detection," Int'l Conf. on Auto. Face Recog., 307–311 (Oct. 1996).
Gutta et al., "Faces and Hand Gesture Recognition Using Hybrid Classifiers," Int'l Conf. on Auto. Face Recog., 164–169 (Oct. 1996).

* cited by examiner

*Primary Examiner*—Thomas J Mullen, Jr.
(74) *Attorney, Agent, or Firm*—Gregory L. Thorne

(57) ABSTRACT

A method and apparatus are disclosed for monitoring a location using vision-based technologies and to automatically trigger the activation of a child safety feature or an alarm when a child is detected. One or more image capture devices are focused on a given location. The captured images are processed to identify the presence of a child and to initiate an appropriate response, such as sending assistance, activating a child safety feature or triggering an alarm. A number of rules can be utilized to define various child safety events. Each rule contains one or more conditions that must be satisfied in order for the rule to be triggered, and, optionally, a corresponding action-item that should be performed when the rule is satisfied, such as sending assistance, activating a child safety feature or triggering an alarm.

14 Claims, 4 Drawing Sheets

CHILD SAFETY EVENT DATABASE-- 200

| | RULE CRITERIA 250 | ACTION 260 |
|---|---|---|
| 205 | CHILD IS DETECTED NEAR OVEN | ACTIVATE CHILD-LOCK TO PREVENT ACTIVATION OF OVEN |
| 206 | CHILD IS DETECTED IN BACKYARD OUTSIDE OF DEFINED POOL ZONE | SEND NOTIFICATION TO SUPERVISING ADULT |
| 209 | • • • | |
| 210 | CHILD IS DETECTED INSIDE OF DEFINED POOL ZONE | ACTIVATE ALARM |

FIG. 2

VISION-BASED METHOD AND APPARATUS FOR AUTOMATICALLY ACTIVATING A CHILD SAFETY FEATURE

FIELD OF THE INVENTION

The present invention relates to methods and apparatus for controlling appliances and other dangerous devices, such as microwave ovens, stoves and irons, and more particularly, to a vision-based method and apparatus for automatically detecting the presence of a child and to automatically activate a child safety feature.

BACKGROUND OF THE INVENTION

The marketplace offers a number of consumer appliances, such as microwave ovens, stoves and irons, that provide an ever-growing number of features intended to increase the safety and convenience of these appliances. Many appliances, for example, have a child safety feature that prevents the appliance from being easily activated by a child. While such child safety features have significantly reduced the occurrence of injuries to children, they typically require the affirmative action of an adult or another user to manually activate the child safety feature.

In addition, children may be exposed to danger when they are merely in the vicinity of certain appliances or other dangerous zones. For example, children may get burned if they touch an oven or range that is in use. Similarly, a backyard pool is another well-known hazard that requires diligent supervision of children by an adult. A number of perimeter monitoring tools exist that allow such dangerous zones to be protected by activating an alarm when a child or another object enters the protected zone. Generally, such perimeter monitoring tools employ audio or optical techniques to detect sound in a protected zone or to detect when an optical beam surrounding a protected zone has been broken, respectively. As a result, there is a significant potential for false alarms when objects other than a child, such as a pet or an authorized adult, enter the zone.

A need therefore exists for a method and apparatus for detecting the presence of a child and for automatically triggering the activation of a child safety feature or an alarm. A further need therefore exists for an appliance controller that prevents a child from utilizing a dangerous device or triggers an alarm to notify an adult of the presence of a child in a dangerous area.

SUMMARY OF THE INVENTION

Generally, a method and apparatus are disclosed for monitoring a location using vision-based technologies and to automatically trigger the activation of a child safety feature or an alarm when a child is detected. The disclosed child safety monitoring system includes one or more image capture devices that are focused on a given location. The captured images are processed by the child safety monitoring system to identify the presence of a child and to initiate an appropriate response, such as sending assistance, activating a child safety feature or triggering an alarm.

According to one aspect of the invention, a number of rules are utilized to define various child safety events. Each rule contains one or more conditions that must be satisfied in order for the rule to be triggered, and, optionally, a corresponding action-item that should be performed when the rule is satisfied, such as sending assistance, activating a child safety feature or triggering an alarm. At least one condition for each rule identifies a feature that must be detected in an image using vision-based techniques. Upon detection of a predefined child safety event, the corresponding action is performed by the child safety monitoring system.

A more complete understanding of the present invention, as well as further features and advantages of the present invention, will be obtained by reference to the following detailed description and drawings.

BRIEF DESCRIPTION OF THE DRAWINGS

FIG. 2 illustrates a sample table from the child safety event database of FIG. 1;

DETAILED DESCRIPTION

Figure 1:
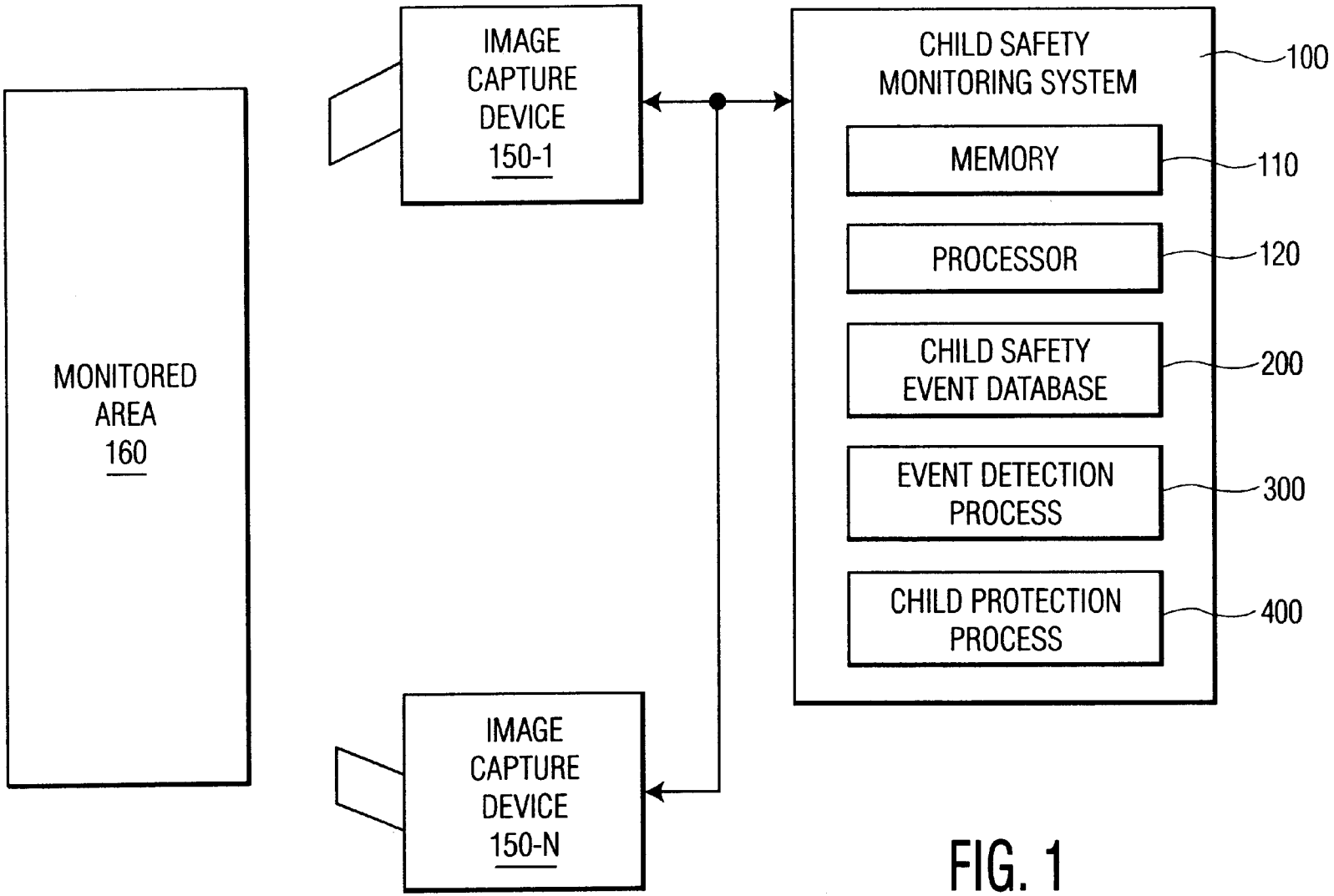
FIG. 1 illustrates a child safety monitoring system in accordance with the present invention.

FIG. 1 illustrates a child safety monitoring system 100 in accordance with the present invention. Generally, the child safety events detected by the present invention are those events involving the protection of children. As shown in FIG. 1, the child safety monitoring system 100 includes one or more image capture devices 150-1 through 150-N (hereinafter, collectively referred to as image capture devices 150) that are focused on one or more monitored areas 160. The monitored area 160 can be any location that is likely to expose a child to harm.

According to one aspect of the invention, the monitored areas 160 are observed using vision-based technologies. If a predefined child safety event is detected, a child safety feature or an alarm (or both) is automatically activated in accordance with the present invention. The images captured by the image capture devices 150 are processed by the child safety monitoring system to identify a child safety event, such as the presence of a child, and to initiate an appropriate response, such as sending assistance, activating a child safety feature or triggering an alarm.

Each image capture device 150 may be embodied, for example, as a fixed or pan-tilt-zoom (PTZ) camera for capturing image or video information. The images generated by the image capture devices 150 are processed by the child safety monitoring system 100, in a manner discussed below in conjunction with FIGS. 3 and 4, to identify one or more predefined child safety events. In one implementation, the present invention employs a child safety event database 200, discussed further below in conjunction with FIG. 2, that records a number of rules defining various child safety events.

The child safety events defined by each rule may be detected by the child safety monitoring system 100 in accordance with the present invention. As discussed further below, each rule contains one or more criteria that must be satisfied in order for the rule to be triggered, and, optionally, a corresponding action-item that should be performed when the predefined criteria for initiating the rule is satisfied. At least one of the criteria for each rule is a condition detected in an image using vision-based techniques, in accordance with the present invention. Upon detection of such a predefined child safety event, the corresponding action, if any, is performed by the child safety monitoring system 100, such as sending assistance, activating a child safety feature or triggering an alarm.

As shown in FIG. 1, and discussed further below in conjunction with FIGS. 3 and 4, the child safety monitoring system 100 also contains a child safety event detection process 300 and a child protection process 400. Generally, the child safety event detection process 300 analyzes the images obtained by the image capture devices 150 and detects a number of specific, yet exemplary, events defined in the child safety event database 200. The child protection process 400 analyzes the images obtained by the image capture devices 150, detects when a child is present, and activates a child safety feature.

The child safety monitoring system 100 may be embodied as any computing device, such as a personal computer or workstation, that contains a processor 120, such as a central processing unit (CPU), and memory 110, such as RAM and/or ROM. In an alternate implementation, the image processing system 100 may be embodied using an application specific integrated circuit (ASIC).

FIG. 2 illustrates an exemplary table of the child safety event database 200 that records each of the rules that define various child safety events. Each rule in the child safety event database 200 includes predefined criteria specifying the conditions under which the rule should be initiated, and, optionally, a corresponding action item that should be triggered when the criteria associated with the rule is satisfied. Typically, the action item defines one or more appropriate step(s) that should be performed when the rule is triggered, such as sending assistance, activating a child safety feature or triggering an alarm.

As shown in FIG. 2, the exemplary child safety event database 200 maintains a plurality of records, such as records 205–210, each associated with a different rule. For each rule, the child safety event database 200 identifies the rule criteria in field 250 and the corresponding action item, if any, in field 260. For example, the rule recorded in record 206 is an event corresponding to a child being detected in a backyard, but outside of a defined pool zone. Thus, a child is in the vicinity of a dangerous area, but has not yet entered the dangerous area. If the event defined by record 206 is detected, the corresponding action consists of sending notification to the adult who is supervising the detected child, as indicated in field 260.

Figure 3:
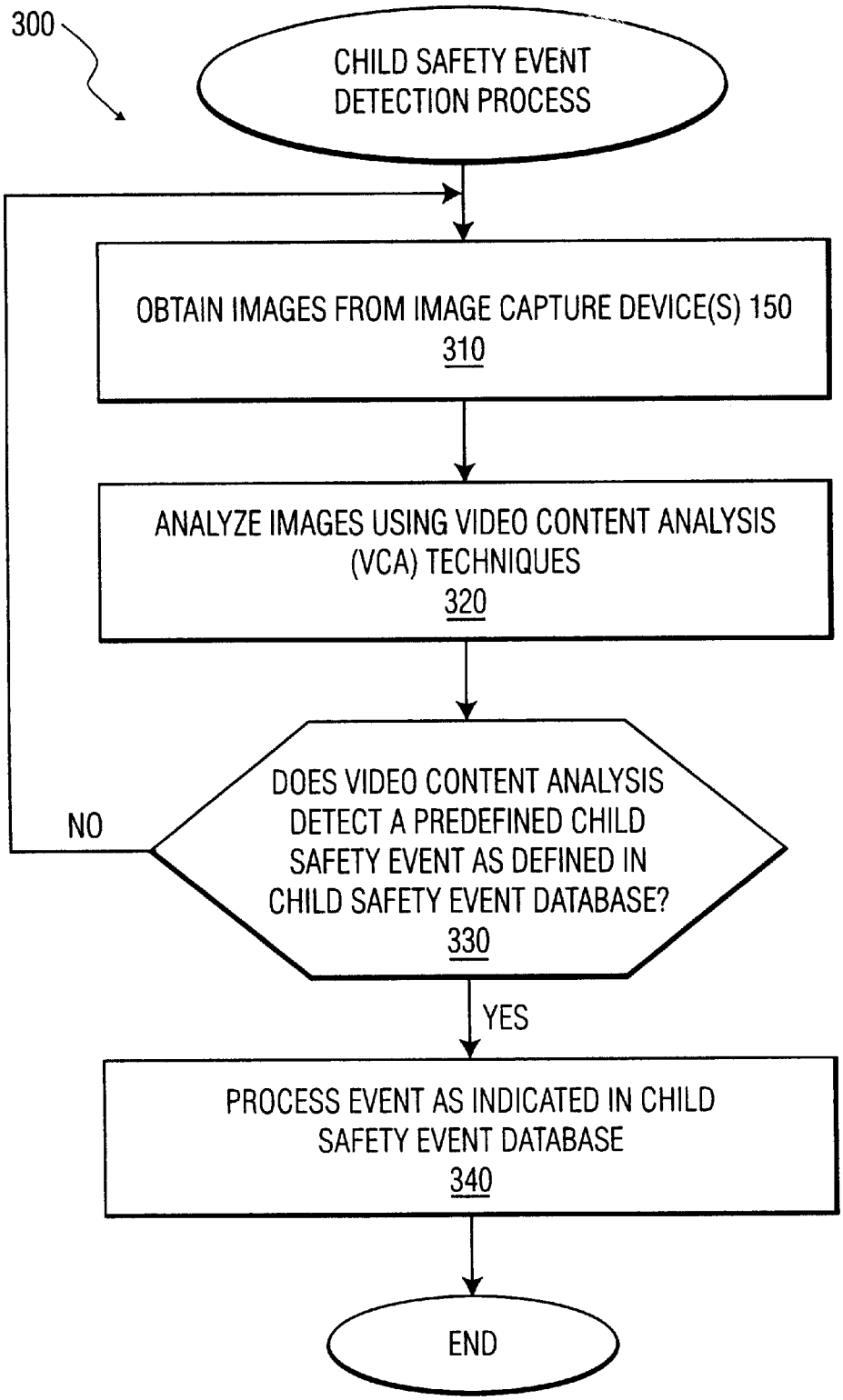
FIG. 3 is a flow chart describing an exemplary child safety event monitoring process embodying principles of the present invention.
Figure 4:
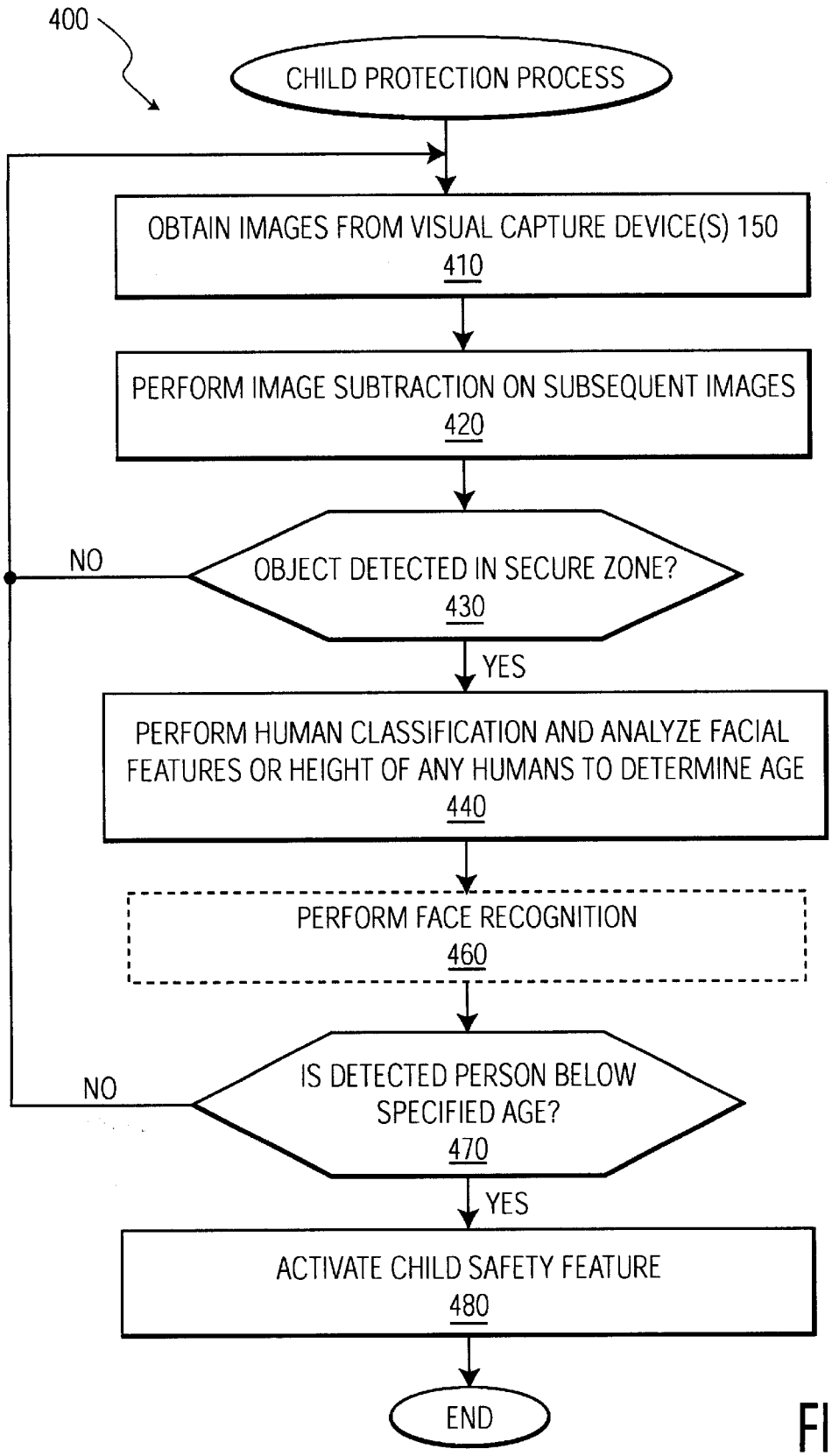
FIG. 4 is a flow chart describing an exemplary child protection process incorporating features of the present invention.

FIG. 3 is a flow chart describing an exemplary child safety event detection process 300. The child safety event detection process 300 analyzes images obtained from the image capture devices 150 and detects a number of specific, yet exemplary, events defined in the child safety event database 200. As shown in FIG. 3, the child safety event detection process 300 initially obtains one or more images of the monitored area 160 from the image capture devices 150 during step 310.

Thereafter, the images are analyzed during step 320 using video content analysis (VCA) techniques. For a detailed discussion of suitable VCA techniques, see, for example, Nathanael Rota and Monique Thonnat, "Video Sequence Interpretation for Visual Surveillance," in Proc. of the 3d IEEE Int'l Workshop on Visual Surveillance, 59–67, Dublin, Ireland (Jul. 1, 2000), and Jonathan Owens and Andrew Hunter, "Application of the Self-Organizing Map to Trajectory Classification,' in Proc. of the 3d IEEE Int'l Workshop on Visual Surveillance, 77–83, Dublin, Ireland (Jul. 1, 2000), incorporated by reference herein. Generally, the VCA techniques are employed to recognize various features in the images obtained by the image capture devices 150.

A test is performed during step 330 to determine if the video content analysis detects a predefined child safety event, as defined in the child safety event database 200. If it is determined during step 330 that the video content analysis does not detect a predefined child safety event, then program control returns to step 310 to continue monitoring the location(s) 160 in the manner discussed above.

If, however, it is determined during step 330 that the video content analysis detects a predefined child safety event, then the child safety event is processed during step 340 as indicated in field 260 of the child safety event database 200. Program control then terminates (or returns to step 310 and continues monitoring location(s) 160 in the manner discussed above).

As previously indicated, the child protection process 400 analyzes the images obtained by the image capture devices 150, detects when a child is present, and activates a child safety feature. As shown in FIG. 4, the child protection process 400 initially obtains one or more images of the monitored area 160 from the image capture devices 150 during step 410.

Thereafter, subsequent image frames are subtracted during step 420 to detect a new object. A test is performed during step 430 to determine if an object is detected in a secure zone. If an object is not detected in a secure zone during step 430, then program control returns to step 410 to continue monitoring the location(s) 160 in the manner discussed above.

If, however, an object is detected in a secure zone during step 430, then well-known human classification techniques are optionally employed during step 440 (to confirm the detected object is a human) and the facial feature or height of any detected humans are analyzed during step 440 to determine the age of the person. The age of an individual may be obtained using the techniques taught, for example, in U.S. Pat. No. 5,781,650, issued to Lobo et al., incorporated by reference herein. Furthermore, an age estimate may be obtained by evaluating height information, in the manner described in Antonio Criminisi et al., "A New Approach to Obtain Height Measurements from Video," Proc. of SPIE, Boston, Mass., Vol. 3576 (Nov. 1–6, 1998), incorporated by reference herein.

A face recognition analysis can optionally be performed during step 460. Face recognition is typically preceded by a face detection process. The face detection may be performed in accordance with the teachings described in, for example, International Patent WO9932959, entitled "Method and System for Gesture Based Option Selection, assigned to the assignee of the present invention, Damian Lyons and Daniel Pelletier; "A Line-Scan Computer Vision Algorithm for Identifying Human Body Features," Gesture'99, 85–96 France (1999); Ming-Hsuan Yang and Narendra Ahuja, "Detecting Human Faces in Color Images," Proc. of the 1998 IEEE Int'l Conf. on Image Processing (ICIP 98), Vol. 1, 127–130, (October, 1998); and I. Haritaoglu, D. Harwood, L. Davis, "Hydra: Multiple People Detection and Tracking Using Silhouettes," Computer Vision and Pattern Recognition, Second Workshop of Video Surveillance (CVPR, 1999), each incorporated by reference herein.

The face recognition may be performed on one of the faces detected in accordance with the teachings described in, for example, Antonio Colmenarez and Thomas Huang, "Maximum Likelihood Face Detection," 2nd Int'l Conf. on Face and Gesture Recognition, 307–311, Killington, Vermont (Oct. 14–16, 1996) and Srinivas Gutta et al., "Face and Gesture Recognition Using Hybrid Classifiers," 2d Int'l Conf. on Face and Gesture Recognition, 164–169, Killington, Vermont (Oct. 14–16, 1996), incorporated by reference herein.

A further test is performed during step 470 to determine if the detected person(s) are below a specified age. If the person is not below the specified age (i.e., the detected person is not a "child"), then program control returns to step 410. to continue monitoring the location(s) 160 in the manner discussed above.

If, however, it is determined during step 470 that the detected person is below a specified age (i.e., the detected person is a "child"), then a child safety feature is activated in accordance with the present invention during step 480. For example, the child safety feature may be activation of a child-lock on one or more appliances in the monitored area 160, notification of an adult, or triggering an alarm.

It is to be understood that the embodiments and variations shown and described herein are merely illustrative of the principles of this invention and that various modifications may be implemented by those skilled in the art without departing from the scope and spirit of the invention.

What is claimed is:

1. A method for automatically activating a child safety feature, comprising:

obtaining at least one image of a monitored location;

analyzing said image using video content analysis techniques to detect a child in said image; and activating a child safety feature if said child is detected, wherein said child safety feature is one of sending assistance for said child and activating a child lock feature on an appliance.

2. The method of claim 1, wherein said child safety feature includes triggering an alarm.

3. The method of claim 1, further comprising the step of estimating the age of a person detected in said image.

4. The method of claim 1, further comprising the step of estimating the height of a person detected in said image.

5. The method of claim 1, further comprising the step of identifying a person detected in said image.

6. A method for detecting a child in a monitored location, comprising:

obtaining at least one image of said monitored location;

analyzing said image using video content analysis techniques to detect a child in said image; and performing a predefined action if said child is detected in said monitored location; and further comprising one of:

estimating the age of a person detected in said image; and identifying a person detected in said image.

7. The method of claim 6, wherein said predefined action includes sending assistance for said child.

8. The method of claim 6, wherein said predefined action includes activating a child lock feature on an appliance.

9. The method of claim 6, wherein said predefined action includes triggering an alarm.

10. The method of claim 6, further comprising the step of establishing a rule defining a child safety event, said rule including at least one condition to detect the presence of a child.

11. A system for automatically activating a child safety feature, comprising:

a memory for storing computer readable code; and a processor operatively coupled to said memory, said processor configured to:

obtain at least one image of a monitored location;

analyze said image using video content analysis techniques to detect a child in said image; and activate a child safety feature if said child is detected, wherein said child safety feature includes one of sending assistance for said child and activating a child lock feature on an appliance.

12. The system of claim 11, wherein said child safety feature includes triggering an alarm.

13. A system for automatically activating a child safety feature, comprising:

means for obtaining at least one image of a monitored location;

means for analyzing said image using video content analysis techniques to detect a child in said image; and means for activating a child safety feature if said child is detected, wherein said child safety feature includes one of sending assistance for said child and activating a child lock feature on an appliance.

14. An article of manufacture automatically activating a child safety feature, comprising:

a computer readable medium having computer readable code means embodied thereon, said computer readable program code means comprising:

a step to obtain at least one image of a monitored location;

a step to analyze said image using video content analysis techniques to detect a child in said image; and a step to activate a child safety feature if said child is detected; and further comprising one of:

a step to estimate the age of a person detected in said image; and a step to identify a person detected in said image.

* * * * *